US005772315A

United States Patent [19]

Shen

[11] Patent Number: 5,772,315

[45] Date of Patent: Jun. 30, 1998

[54] LAMP TRACK CLAMP STRUCTURE

[76] Inventor: Wei-Hong Shen, 6F, No. 416, Sec. 4, Jen-Ai Rd., Taipei, Taiwan

[21] Appl. No.: 955,927

[22] Filed: Oct. 22, 1997

[51] Int. Cl.[6] ..... F21V 21/00

[52] U.S. Cl. ..... 362/396; 362/250; 362/404; 362/430

[58] Field of Search ..... 362/147, 239, 362/250, 396, 404, 430, 801; 439/116

[56] References Cited

U.S. PATENT DOCUMENTS 4,118,760 10/1978 Cohon ..... 362/239

5,128,847 7/1992 Lin et al. ..... 362/226

5,455,754 10/1995 Hoffner ..... 362/250

*Primary Examiner*—Stephen F. Husar

*Attorney, Agent, or Firm*—Rosenberg, Klein, & Bilker

[57] ABSTRACT

A type of lamp track clamp structure, comprising a main unit, first fixing pieces, second fixing pieces, clamp pieces and conductive screws, the first fixing pieces and the second fixing pieces are installed in the main unit, the two clamp pieces are fitted on the front and back sides of the main unit, the conductive screws are screwed through the clamp pieces and the main unit to compose a lamp track clamp structure; the above configuration is so designed that the track clamp may involve a universal purpose to significantly reduce production costs and enable convenient operation.

3 Claims, 4 Drawing Sheets

LAMP TRACK CLAMP STRUCTURE

BACKGROUND OF THE INVENTION

The subject invention relates to a type of lamp track clamp structure, particularly to one with a universal purpose and convenient operation.

With the advancement of living standards, lighting fixtures have gradually received the attention by the general consumers. In view of such potential market in lighting and lamp products, the manufacturers have devoted their efforts in the research and development of new products, ranging from wall lamps, ceiling lamps, desk lamps, table lamps, floor lamps or track lighting, etc., various types and designs have been put on the market, among them, the track lighting has gradually been widely claimed by the consumers. The conventional track lighting requires the equipment of proper track clamp, to fix the lamp onto the conductive track on a ceiling, so that the power source is transmitted from the transformer to the conductive track, the track clamp and to the lamp.

However, most conventional track clamps are designed to suit a specific application, different lamp models could not be applied to a same track clamp because of wiring design or other restrictions, as a result, various models of track clamps must be designed to suit the application of various lamp types, such track clamps will not have universal applications, hence the increased production costs, and subsequent difficulties for the manufacturers.

SUMMARY OF THE INVENTION

The primary objective of the subject invention is to present a type of lamp track clamp structure, comprising a main unit, first fixing pieces, second fixing pieces, clamp pieces and conductive screws, the first fixing pieces and the second fixing pieces are installed in the main unit, the two clamp pieces are fixed onto the front and back sides of the main unit, the conductive screws are inserted through the clamp pieces, the main unit, the first fixing pieces and the second fixing pieces, the two clamp pieces are fastened onto the front and back sides of the main unit, the first fixing pieces and the second fixing pieces are fastened in the main unit, to compose a lamp track clamp structure, and in order to suit the application to different lamp models, the first fixing pieces and the second fixing pieces may be properly interchanged, so that various lamp models may be fitted to the same track clamp, said track clamp having a universal purpose that will significantly reduce the production costs and enable convenient operation.

To enable better understanding of the characteristics and technical contents of the subject invention, please refer to the following detailed description with drawings; however, the attached drawings are only for the purposes of reference and description, which shall not be based to restrict or limit the subject invention:

BRIEF DESCRIPTION OF NUMERALS

| | |
|---|---|
| 10 main unit | |
| 11 depressed chamber | 12 conductive wire hole |
| 13 niche | 14 partition plate |
| 15 through hole | |
| 20 first fixing piece | |
| 21 screw hole | 22 conductive wire hole |
| 23 conductive wire | 24 screw hole |
| 25 fixing screw | |
| 30 second fixing piece | |
| 31 screw hole | |
| 40 clamp piece | |
| 41 clamping part | 42 through hole |
| 50 conductive screw | |
| 60 conductive track | |
| 61 conductive element | |
| 70 lamp | |
| 71 conductive bracket | |

DETAILED DESCRIPTION OF PREFERRED EMBODIMENT

Figure 1:
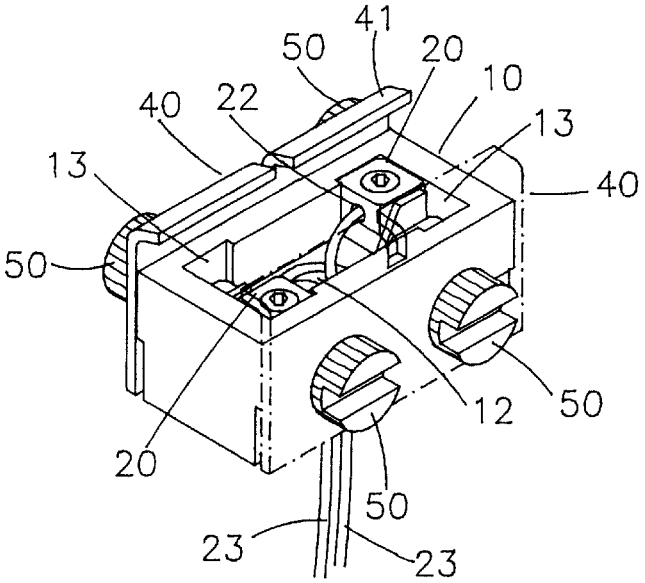
FIG. 1 is an exploded view of the subject invention.
Figure 2:
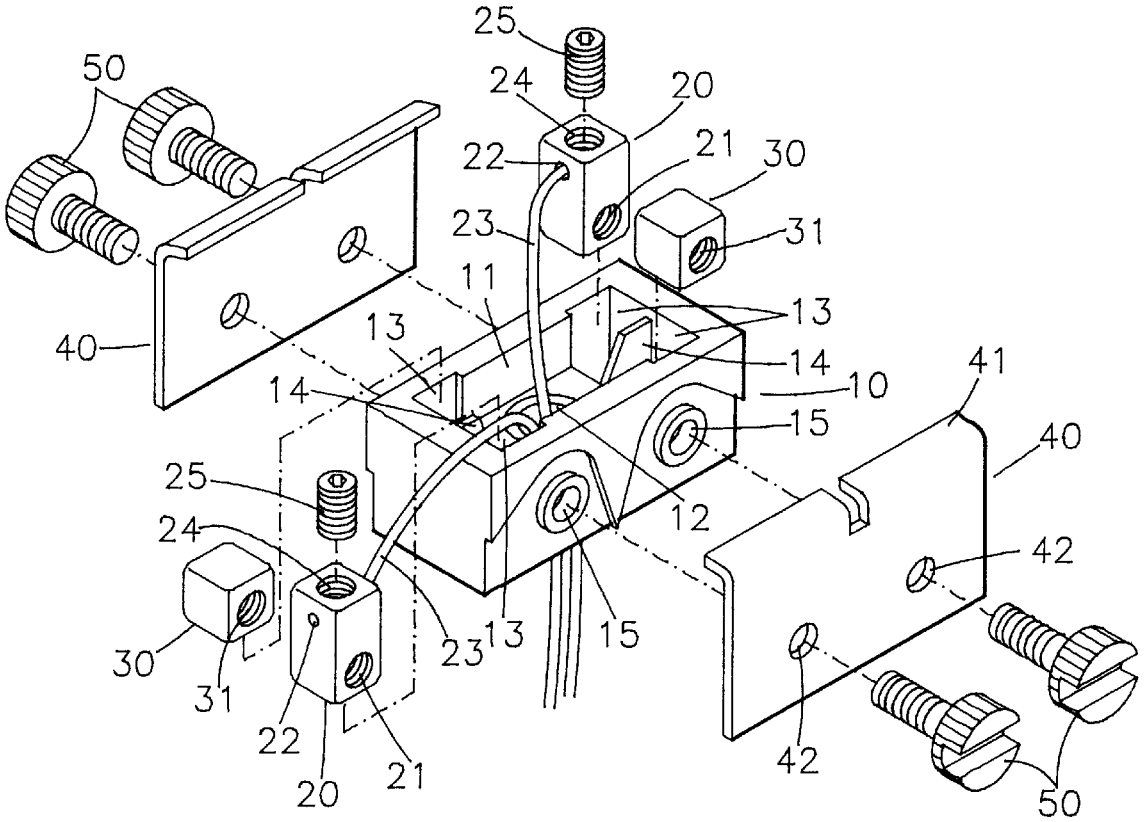
FIG. 2 is a perspective assembled view of the subject invention.

Please refer to FIGS. 1 and 2 which are respectively an exploded view and a perspective assembled view of the subject invention. The subject invention relates to the presentation of a lamp track clamp structure, comprising a main unit 10, two first fixing pieces 20, two second fixing pieces 30, two clamp pieces 40 and four conductive screws 50, said main unit 10 is made of an insulating material, in the shape of a rectangular block, inside which is a depressed chamber 11 with a opening on its top, on the bottom in the middle of said depressed chamber 11 is a vertically through conductive wire hole 12, at each of the four comers inside the depressed chamber 11 is a niche 13, between the two niches on the same side is a partition plate 14 that separates the two niches, at the front and back sides of the main unit 10 are two horizontally through holes 15, the four through holes 15 are so located to match the four niches 13.

The first fixing piece 20, made of a conductive material, is in the shape of a square post, the two first fixing pieces 20 are respectively accommodated in the niches 13 at the front and back sides inside the main unit 10, in each of the first fixing pieces 20 is a screw hole 21 that is horizontally through and located to match the through hole 15 on the main unit 10, on each of the two first fixing pieces 20 is a conductive wire hole 22 that may be used for the connection of conductive wire 23, said conductive wire 22 may be inserted by one end of the conductive wire 23 in the first fixing piece 20, on the first fixing piece 20 is a screw hole 24 to accommodate the fixing screw 25, by tightening the fixing screw 25, the end of the conductive wire 23 that is inserted in the first fixing piece 20 can be tightened in the conductive wire hole, so the end of the conductive wire 23 is fixed to the first fixing piece 20.

The second fixing piece 30, made of a conductive material, is in the shape of a lower square post, the two second fixing pieces 30 are respectively accommodated in another niches 13 at the front and back sides inside the main unit 10, each of the second fixing pieces 30 has a horizontally through screw hole 31 that is located to match the through hole 15 on the main unit 10.

The clamp piece 40 is in the shape of a rectangular plate, with its top edge bent to form a clamping part 41, the clamping piece 40 has two through holes 42 that are located to match the through holes 15 on the main unit 10, the two clamp pieces 40 are respectively fitted to the front and back sides of the main unit 10, the clamping part 41 on top of the clamp piece 40 is kept at a proper distance from the top of the main unit 10.

The conductive screws 50 are screwed, in sequence, through the through holes 42 on the clamp pieces, the screw holes 21 and 31 in the first fixing pieces 20 and the second fixing pieces 30, to fasten the two clamp pieces 40 onto the front and back sides of the main unit 10, and the two first fixing pieces 20 and the two second fixing pieces 30 are fastened in the four niches 13 in the main unit 10, to compose an integrated lamp track clamp structure.

Figure 3:
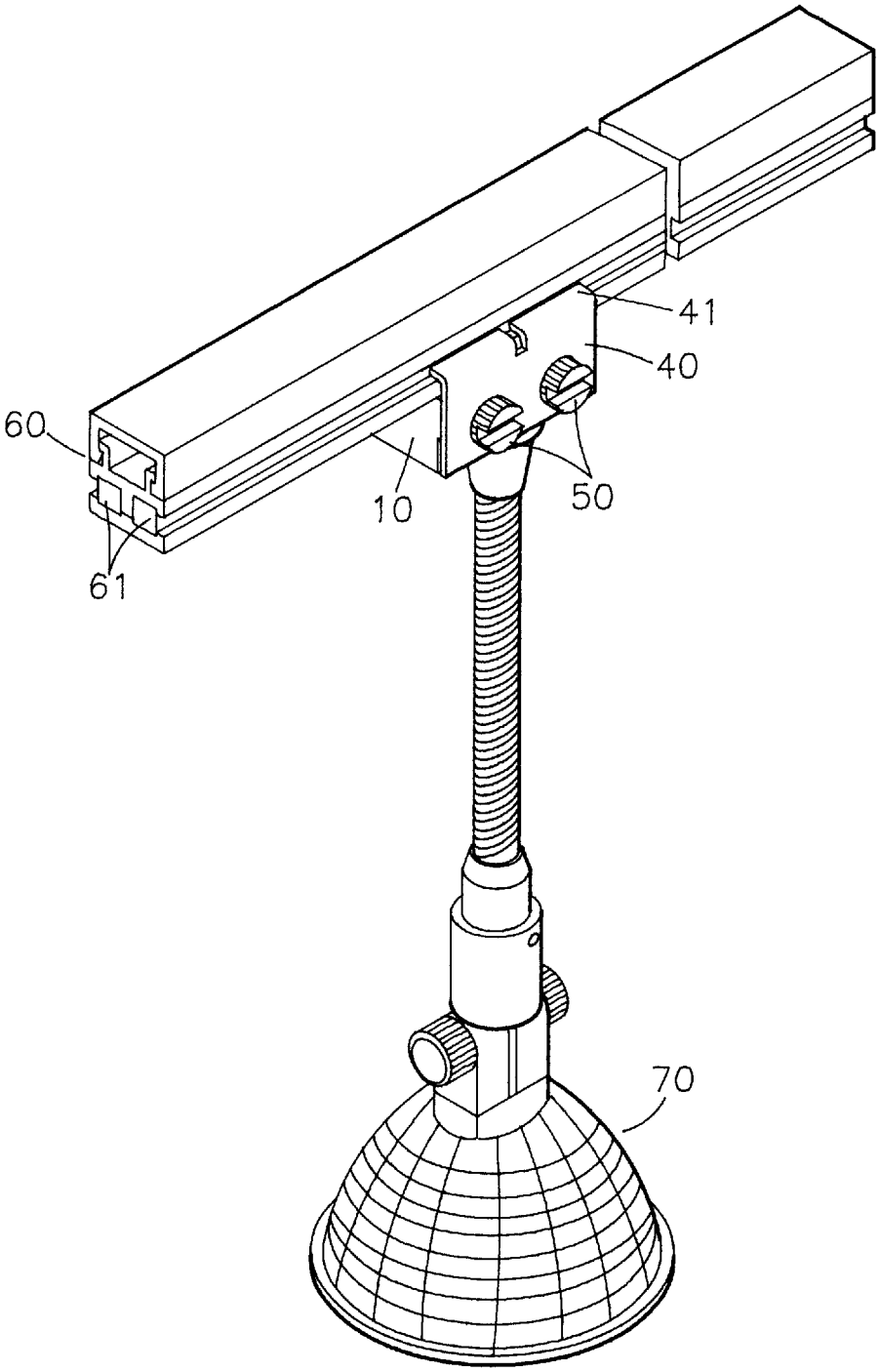
FIG. 3 is an illustration of an embodiment of the subject invention in application with a lamp.

Please refer to FIG. 3 which is an illustration of an embodiment of the subject invention in application with a lamp, the conductive track 60 (a prior art) is an elongated lever with an appropriate length that may be fixed onto a ceiling or similar locations, inside each of two sides of said conductive track 60 is a conductive element 61, the subject invention of the track clamp involves a clearance between the clamping parts 41 on the clamp pieces 40 and the top of the main unit, that serves to clamp and fix the main unit onto the conductive track 60, by tightening the conductive screws 50, the lamp 70 can be properly joined to the main unit 10, the two conductive elements 61 in the conductive track 60 serve to transmit the power from the transformer (not shown in drawing) to the two clamp pieces 40, to the two conductive screws 50, then, to the two first fixing pieces 20 and the two conductive wires 23, the other ends of the two conductive wires 23 are connected with the lamp 70, so the power supply can be transmitted to the lamp 70.

Figure 4:
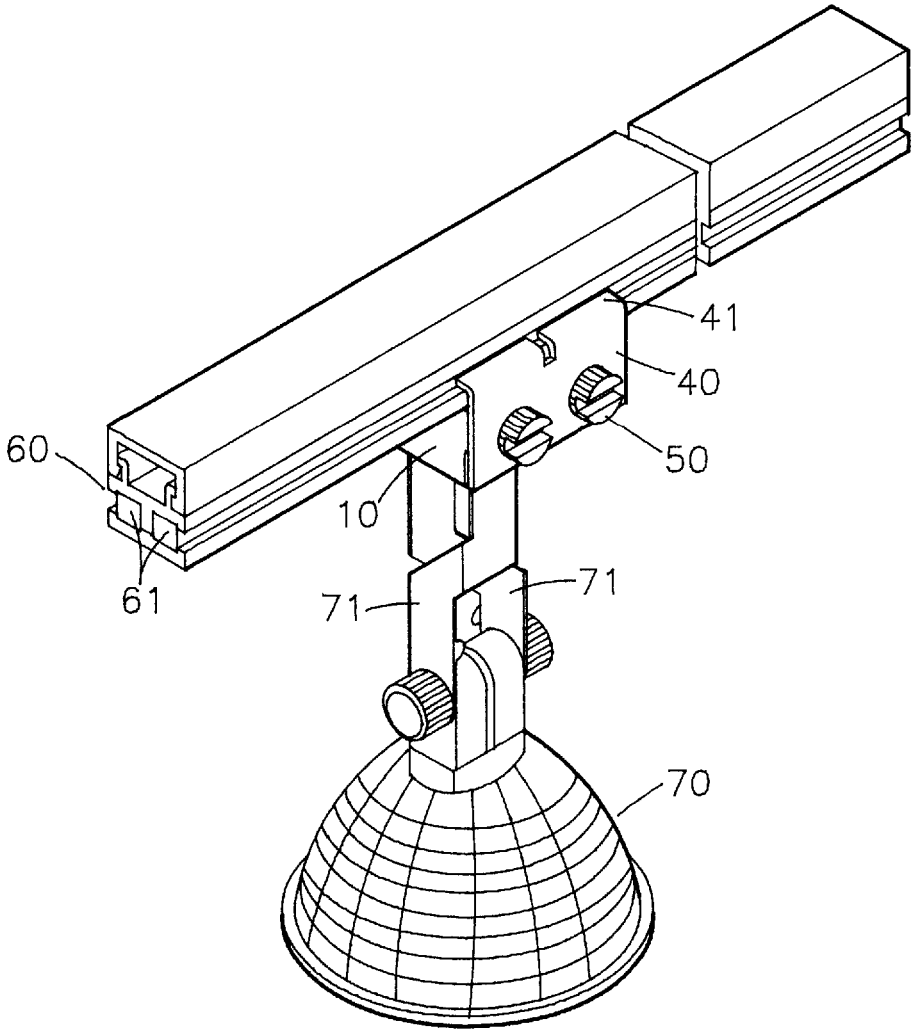
FIG. 4 is an illustration of an embodiment of the subject invention in application with another lamp.

Please refer to FIG. 4 which is an illustration of an embodiment of the subject invention in application with another lamp, said lamp 70 has two conductive brackets 71, the tops of the two conductive brackets 71 can be fastened to between the two clamp pieces 40 and the main unit 10, with the conductive screws 50 inserted through the conductive brackets 71, the two conductive elements in said conductive track 60 will transmit power source to the two clamp pieces 40, then through the two clamp pieces 40 and the two conductive screws 50, directly to the two conductive brackets 71 and the lamp 70, therefore, the two first fixing pieces 20 will not need the conductive wire 23, and the two first fixing pieces 20 may be replaced by two second fixing pieces 30, that is, four second fixing pieces 30 to be installed in the main unit 10; of course, the first fixing pieces 20 and the second fixing pieces 30 may be interchanged properly to suit the lamp in application, for instance, the two second fixing pieces 30 may be replaced by two first fixing pieces 20, so there are four first fixing pieces 20 installed inside the main unit 10. Another alternative is that, the numbers of the first fixing pieces 20, the second fixing pieces 30 and the conductive screws 50 may be increased or decreased to suit the applications, and the configuration of the main unit 10 and the two clamp pieces 40 may also be altered, so that the track clamp can suit the application of different numbers of lamp (one or three, etc.).

Figure 5:
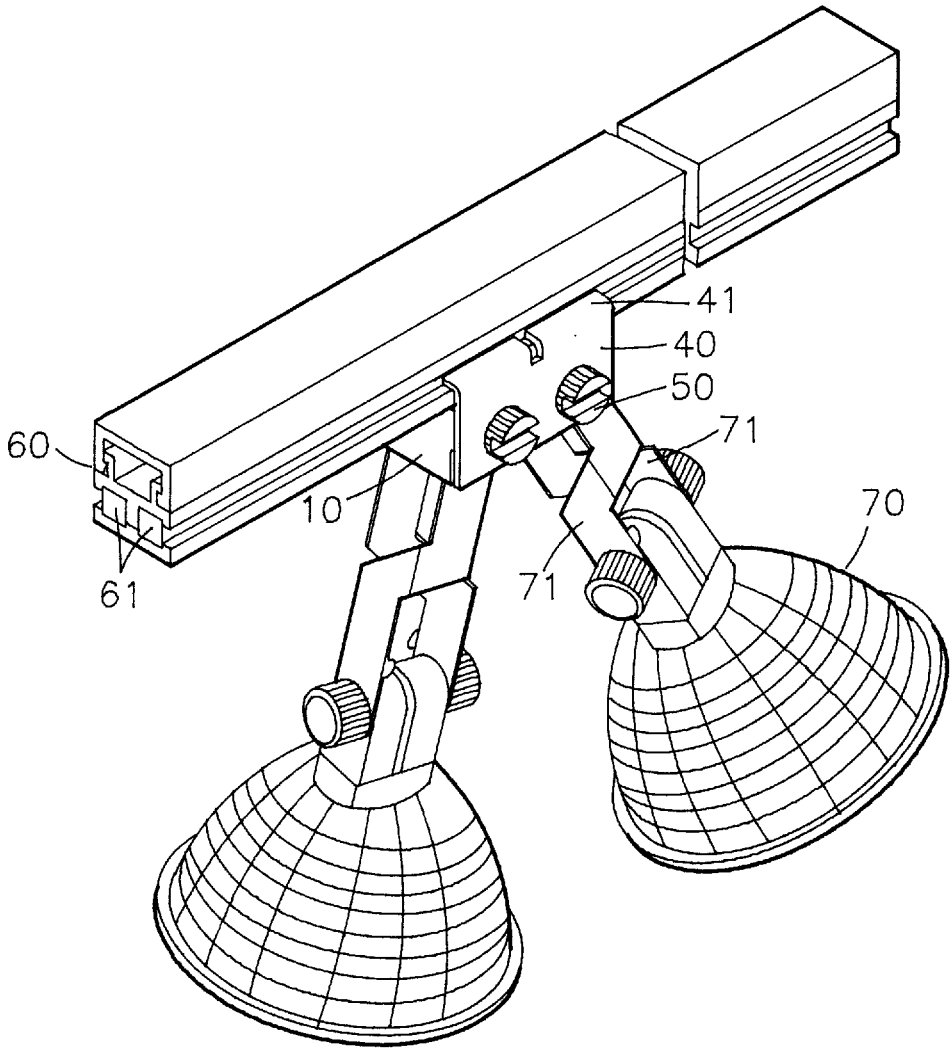
FIG. 5 is an illustration of an embodiment of the subject invention in application with yet another lamp.

Please refer to FIG. 5 which is an illustration of an embodiment of the subject invention in application with yet another lamp, such a type of lamp 70 with the equipment of conductive brackets 71 may be composed of two sets that are fitted onto the track clamp, so that the two first fixing pieces 20 are replaced by two second fixing pieces 30, that is, four second fixing pieces 30 are installed in the main unit 10, the two conductive elements 61 in said conductive track 60 serve to transmit power source to the two clamp pieces 40, the four conductive screws 50 to the four conductive brackets 71 and the two lamps 70.

To suit the application of different lamp models in the track clamp of the subject invention, the wiring of the first fixing pieces 20 and the second fixing pieces 30 in the main unit 10 may be switched properly, such as the installation of the first fixing pieces 20 in case conductive wires are needed, or the installation of the second fixing pieces 30 in case conductive wires are not needed, so that different lamp models may be applicable to a same type of track clamp, therefore, there will not be the need to design various models of track clamp in order to suit the various type of lamp, said track clamp may have a universal purpose to significantly reduce production costs and enable convenient operation.

Summing up, the subject invention, with effective improvement on such weaknesses in conventional types of lamp track clamps as lack of universal purpose, higher production costs, etc., is an unprecedented new version with originality and an inventive step that will fully satisfy the qualifications for a patent right, hence this application is filed in accordance with the Patent Law to protect the subject inventor's rights and interests. Your favorable consideration shall be appreciated.

It is declared hereby that the above description, covering only the preferred embodiment of the subject invention, should not be based to limit or restrict the subject claim, and that all equivalent structural and/or configurational variations and/or modifications easily conceivable to anyone skilled in the subject art, and deriving from the subject description with drawings herein shall reasonably be included in the intent of the subject claim.

I claim:

1. A type of lamp track clamp structure, comprising:

two first fixing pieces, made of a conductive material, each of the two first fixing pieces being accommodated in a niche at the front and back sides in the main unit, each of the first fixing pieces having a screw hole that is located to match the through hole on the main unit, each of the two first fixing pieces having a conductive wire hole for optional connection of conductive wires, there being a screw hole and a fixing screw that serve to fasten the conductive wire;

two second fixing pieces, being respectively accommodated in the niches at the front and back sides of the main unit, each of said second fixing pieces having a screw hole that is located to match the through hole on the main unit;

two clamp pieces, made of a conductive material, with top edges forming the clamping parts, on the clamp pieces being through holes that are located to match the through holes on the main unit, the two clamp pieces are respectively fixed onto the front and back sides of the main unit, there being a clearance between the clamping parts and the top of the main unit; and four conductive screws, being inserted through the through holes on the clamp pieces, the through holes on the main unit, to the screw holes on the first fixing pieces and the second fixing pieces, so the two clamp pieces are fastened onto the front and back sides of the main unit, the two first fixing pieces and the two second fixing pieces being fastened in the four niches in the main unit, to compose a lamp track clamp structure.

2. The lamp track clamp structure, as recited in claim 1, wherein the first fixing pieces and the second fixing pieces may be properly altered to suit the application of various lamp models.

3. The lamp track clamp structure, as recited in claim 1, wherein the numbers of the first fixing pieces, the second fixing pieces and the conductive screws may be properly increased or decreased, and the configurations of the main body and the two clamp pieces may be altered, so that the track clamp may suit the applications of different numbers of lamp.

* * * * *